US010420693B2

(12) United States Patent
Schubert et al.

(10) Patent No.: US 10,420,693 B2
(45) Date of Patent: Sep. 24, 2019

(54) ACTUATOR FOR DELIVERY OF VIBRATORY STIMULATION TO AN AREA OF THE BODY AND METHOD OF APPLICATION

(75) Inventors: Shai Y. Schubert, Brookline, MA (US); Sagi Brink-Danan, Providence, RI (US)

(73) Assignee: Perfuzia Medical, Inc., Providence, RI (US)

( * ) Notice: Subject to any disclaimer, the term of this patent is extended or adjusted under 35 U.S.C. 154(b) by 559 days.

(21) Appl. No.: 14/000,946

(22) PCT Filed: Feb. 22, 2012

(86) PCT No.: PCT/US2012/026068
§ 371 (c)(1),
(2), (4) Date: Dec. 17, 2013

(87) PCT Pub. No.: WO2012/116038
PCT Pub. Date: Aug. 30, 2012

(65) Prior Publication Data

US 2014/0107542 A1 Apr. 17, 2014

Related U.S. Application Data

(60) Provisional application No. 61/445,629, filed on Feb. 23, 2011.

(51) Int. Cl.
*A61H 23/00* (2006.01)
*A61H 1/00* (2006.01)
*A61H 23/02* (2006.01)

(52) U.S. Cl.
CPC ..... *A61H 1/00* (2013.01); *A61H 23/02* (2013.01); *A61H 23/0245* (2013.01);
(Continued)

(58) Field of Classification Search
CPC .... A61H 23/00; A61H 23/02; A61H 23/0245; A61H 2023/002; A61H 2023/0209; H01L 41/053; H01L 41/0533
See application file for complete search history.

(56) References Cited

U.S. PATENT DOCUMENTS 2,518,883 A * 8/1950 Gravley ..... H03H 3/02 156/213
4,607,624 A * 8/1986 Jefferson ..... A61H 23/02 219/217

(Continued)

FOREIGN PATENT DOCUMENTS

JP 03068362 3/1991
JP 2003180843 A 2/2003

(Continued)

OTHER PUBLICATIONS

International Search Report and Written Opinion dated Aug. 22, 2012 in connection with PCT/US2012/026068.

(Continued)

*Primary Examiner* — Michael J Tsai
(74) *Attorney, Agent, or Firm* — Quarles & Brady LLP

(57) ABSTRACT

An actuator delivers mechanical vibrations to the body of a subject. The actuator includes a piezoelectric element, electrodes in electrical communication with an electrical source and the piezoelectric element to drive the piezoelectric element, a polymeric protective layer encapsulating the piezoelectric element and part of the electrodes, and an enclosure attached to the protective layer. The actuator includes a space between the protective layer and the enclosure allowing desired modes of vibration to develop across a surface of the protective layer that encapsulated the piezoelectric element. The actuator can include a skin attachment article that has a mounting pad for attaching to the skin of the subject and for attaching the actuator. The (Continued)

skin attachment article has a cover that overlies the actuator and the mounting pad when the article is attached to the skin of the subject.

19 Claims, 5 Drawing Sheets

(52) U.S. Cl.
CPC ..... *A61H 2201/0207* (2013.01); *A61H 2201/0214* (2013.01); *A61H 2201/10* (2013.01); *A61H 2201/165* (2013.01); *A61H 2201/1695* (2013.01); *A61H 2201/5007* (2013.01); *A61H 2230/00* (2013.01); *A61H 2230/208* (2013.01); *A61H 2230/255* (2013.01); *A61H 2230/505* (2013.01); *A61H 2230/605* (2013.01); *A61H 2230/655* (2013.01)

(56) References Cited

U.S. PATENT DOCUMENTS

| | | | | |
|---|---|---|---|---|
| 5,617,851 | A | 4/1997 | Lipkovker | |
| 6,322,532 | B1 | 11/2001 | D'Sa et al. | |
| 7,182,739 | B2 | 2/2007 | Kopanic et al. | |
| 7,211,060 | B1 * | 5/2007 | Talish | A61N 7/00 600/407 |
| 7,442,168 | B2 | 10/2008 | Novak et al. | |
| 2004/0260214 | A1 | 12/2004 | Echt et al. | |
| 2005/0256431 | A1 * | 11/2005 | Masuda | A61H 23/0245 601/2 |
| 2006/0015045 | A1 * | 1/2006 | Zets | A61H 23/0218 601/78 |
| 2006/0058708 | A1 * | 3/2006 | Heart | A61H 23/0245 601/2 |
| 2006/0149169 | A1 * | 7/2006 | Nunomura | A61B 8/546 601/2 |
| 2007/0232963 | A1 | 10/2007 | Talish et al. | |
| 2010/0228304 | A1 * | 9/2010 | Kriksunov | A61F 7/007 607/3 |
| 2010/0249637 | A1 | 9/2010 | Walter et al. | |
| 2010/0262070 | A1 | 10/2010 | Wang | |
| 2012/0267986 | A1 * | 10/2012 | Galluzzo | B06B 1/0603 310/348 |

FOREIGN PATENT DOCUMENTS

| | | | |
|---|---|---|---|
| JP | 2008113401 | * | 5/2008 |
| WO | 2010093753 A1 | | 8/2010 |

OTHER PUBLICATIONS

Machine transcription of JP 03-068362.
Machine transcription of Japanese Patent 2003180843A.

* cited by examiner

ACTUATOR FOR DELIVERY OF VIBRATORY STIMULATION TO AN AREA OF THE BODY AND METHOD OF APPLICATION

CROSS-REFERENCES TO RELATED APPLICATIONS

This application is a 371 application of PCT/US2012/026068 filed Feb. 22, 2012 which claims priority from U.S. Patent Application No. 61/445,629 filed Feb. 23, 2011.

STATEMENT REGARDING FEDERALLY SPONSORED RESEARCH

Not Applicable.

BACKGROUND OF THE INVENTION

1. Field of the Invention

This invention relates to a method and apparatus for delivering local and/or regional vibrations to a body tissue. In particular, the present invention relates to an actuator for delivery of linear mechanical vibrations to a body tissue that may comprise skin tissue, muscle tissue, glands, fibrous tissue, bone tissue and internal organs, including the brain—in humans as well as in animals and veterinary applications.

2. Description of the Related Art

The application of vibrations as a therapeutic modality was practiced in different forms throughout history. Today vibration therapy is an emerging treatment modality used in sports medicine, orthopedics, rehabilitation medicine, neurological conditions, wound healing, pain alleviation, sensory enhancement and many other fields of medicine (Merkert J, Butz S, Nieczaj R, Steinhagen-Thiessen E, Eckardt R. Combined whole body vibration and balance training using Vibrosphere®: improvement of trunk stability, muscle tone, and postural control in stroke patients during early geriatric rehabilitation. Z Gerontol Geriatr 2011; 44:256-61; Leduc A, Lievens P, Dewald J. The influence of multidirectional vibrations on wound healing and on regeneration of blood- and lymph vessels. Lymphology 1981; 14:179-85; King L K, Almeida Q J, Ahonen H. Short-term effects of vibration therapy on motor impairments in Parkinson's disease. NeuroRehabilitation 2009; 25:297-306; Arias P, Chouza M, Vivas J, Cudeiro J. Effect of whole body vibration in Parkinson's disease: a controlled study. Mov Disord 2009; 24:891-8; Kakigi R, Shibasaki H. Mechanisms of pain relief by vibration and movement. J Neurol Neurosurg Psychiatry 1992; 55:282-6; Magalhaes F H, Kohn A F. Vibratory noise to the fingertip enhances balance improvement associated with light touch. Exp Brain Res 2011; 209:139-51; Johnson A W, Myrer J W, Hunter I, et al. Whole-body vibration strengthening compared to traditional strengthening during physical therapy in individuals with total knee arthroplasty. Physiother Theory Pract 2010; 26:215-25; Adatto M, Adatto-Neilson R, Servant J J, Vester J, Novak P, Krotz A. Controlled, randomized study evaluating the effects of treating cellulite with AWT/EPAT. J Cosmet Laser Ther 2010; 12:176-82; Ozcivici E, Luu Y K, Rubin C T, Judex S. Low-level vibrations retain bone marrow's osteogenic potential and augment recovery of trabecular bone during reambulation. PLoS One 2010; 5:e11178; Xie L, Jacobson J M, Choi E S, et al. Low-level mechanical vibrations can influence bone resorption and bone formation in the growing skeleton. Bone 2006; 39:1059-66; Jobges E M, Elek J, Rollnik J D, Dengler R, Wolf W. Vibratory proprioceptive stimulation affects Parkinsonian tremor. Parkinsonism Relat Disord 2002; 8:171-6.)

Vibratory stimulation of tissues when applied externally or internally can be beneficial for different applications including, but not limited to: tissue perfusion, tissue oxygenation, pain alleviation, muscle injuries, bone injuries, enhancement of bone growth, enhancement of cartilage growth, tissue repair and/or tissue regeneration, inflammation, balance dysfunction, erectile dysfunction, neuropathy, sleep disorders, chronic and other wounds such as pressure ulcers, venous ulcers, arterial ulcers, and diabetic ulcers, burns, surgical wounds, dehisced wounds, preventive treatment for pressure ulcers, transdermal drug delivery, osteoporosis, cellulite removal, neurological conditions, Parkinson's disease tremor reduction, fibromyalgia, veterinary use, and other therapeutic uses.

Several devices have been proposed which deliver vibration to the tissue. These devices use different methods for the delivery of vibratory energy to the skin which include rotating asymmetric motors, linear motors, pneumatic devices, transducer materials, piezoelectric foils, voice coil and piezoelectric actuators. See, for example, PCT International Patent Application Publication Nos. WO 99/48621 and WO 2010/093753, U.S. Patent Application Publication Nos. 2004/0030267 and 2007/0208280, and U.S. Pat. No. 7,211,060.

Piezoelectric actuators are being used for the delivery of linear (as opposed to rotating asymmetric motors) vibratory energy to the body, particularly in applications such as ultrasound, where high frequency (10 kHz-30 kHz), low amplitude vibrations are required. Piezoelectric materials exhibit electromechanical interaction between the mechanical and the electrical states. When an electrical field is applied to a piezoelectric material, it induces a mechanical strain. The mechanical strain in the piezoelectric actuator is directly or indirectly translated into movement.

The use of piezoelectric actuators for the delivery of mechanical vibratory energy to a body tissue is limited for several reasons:

First, driving the piezoelectric actuator typically requires high voltages.

Second, the piezoelectric material must be protected from liquids such as water, sweat, wound exudates, and other bodily or non-bodily liquids that may come in touch with an electric element.

Third, the piezoelectric actuator must be held in place tight against the tissue, preferably having direct contact with the skin or through an adhesive layer or gel such that the vibratory energy is delivered to the tissue. The skin-attachment mechanism must provide good mechanical coupling to facilitate efficient transmission of the vibratory energy into the tissue. Having a breathable skin-attachment mechanism is preferable in order to preserve skin health during the length of use.

Fourth, piezoelectric elements are in many cases fragile and brittle; they break easily and partially or completely lose functionality when exposed to mechanical load. The piezoelectric actuator must have mechanical properties that will allow it to resist pressure from the tissue and various other mechanical loads/stresses that result from body-attachment applications.

Fifth, under mechanical loads the amplitude (travel) of the piezoelectric element is dampened and may be limited. The piezoelectric element must have some free space (air gap) on at least one side of it to develop proper vibratory modes and amplitudes.

What is needed therefore is a method and device for delivering vibratory stimulation to a part of the body using a piezoelectric element that is insulated from the tissue, protected from liquids, has improved resistance to mechanical failure, can develop the desired vibratory modes and amplitudes, and has good mechanical coupling with the body surface (skin or other).

SUMMARY OF THE INVENTION

The present invention meets these needs and requirements by providing a method and a device for delivering vibratory stimulation to a part of the body using a piezoelectric element that is packaged in a polymer such that the piezoelectric element is insulated from the tissue, protected from liquids, has improved resistance to mechanical failure, and can come in direct contact with the skin without risk of electric shock. The polymer packaging, in addition to protecting the piezoelectric element from mechanical damage, also acts to help maintain complete or near-complete piezoelectric actuation even in the presence of cracks, fractures, and other mechanical defects in the piezoelectric element.

Packaging may also include one or more surface electrodes for the actuation of the piezoelectric element, each electrode covering part or all of a surface area of the piezoelectric element. The purpose of such electrodes is to maintain complete or near-complete piezoelectric actuation even in the presence of cracks, fractures and other mechanical defects in the piezoelectric element.

The actuator described in the present invention can be connected by an electrical lead or wirelessly to a controller unit which controls the electrical signal and/or power delivered to the actuator. In some embodiments, there is more than one actuator connected to the same controller unit.

Therefore, in one aspect the invention provides an actuator for delivering mechanical vibrations to the body of a subject (e.g., human or other mammal). The actuator includes one or more piezoelectric elements, electrodes in electrical communication with a power source and the piezoelectric element to drive the piezoelectric element, a protective layer encapsulating the piezoelectric element and at least part of the electrodes wherein the protective layer comprises a polymeric material, and an enclosure attached to the protective layer wherein the enclosure defines a space between the protective layer and the enclosure allowing desired modes of vibration to develop across a surface of the protective layer which encapsulates the piezoelectric element. The polymer-packaged piezoelectric element includes the piezoelectric element, the electrodes, and the protective layer.

The electrodes may be separated from the protective layer and be an independent part or they may be part of the protective layer by being for example laminated to the protective layer. A typical construction of polyimide-copper laminate includes a polyimide base film used as an electrically insulating base material, a thin metal tiecoat (chromium or nickel based alloy, which serves to enhance adhesion), a copper seed-coat, and a layer of electrodeposited copper. Such configuration could be, for example, single or double sided copper clad, flexible adhesive free polyimide dielectric laminates. Available polyimide dielectric laminates include for example DuPont™ Kapton®, DuPont™ Kapton® HN, DuPont™ Pyralux® AC, DuPont™ Pyralux® AP and DuPont™ Interra™ HK.

The protective layer and electrodes may be attached to the piezoelectric element using a glue such as an epoxy glue. Pressure may be applied while attaching the protective layer, electrodes and piezoelectric element to ensure good contact of the electrodes with the piezoelectric element. If a glue such as an epoxy glue is used for attaching the protective layer and electrodes to the piezoelectric element, heat may be applied in order to enhance curing of the glue. Alternatively other glues such as acrylic based glues can be used.

In one form of the present invention, the polymer-packaged piezoelectric element is shaped as a flat disc and is fixed to the rigid or semi-rigid enclosure such that the perimeter of the polymer-packaged piezoelectric element is affixed to the perimeter of the enclosure, thus providing mechanical lip-conditions (preventing/minimizing motion of the polymer-packaged piezoelectric element at the perimeter) and allowing a diaphragm-like movement at the center of the circular polymer-packaged piezoelectric element. The enclosure also provides free-space on one side of the polymer-packaged piezoelectric element (preferably the side far away from the skin), so that desired vibratory modes and desired amplitudes can develop across the surface of the polymer-packaged piezoelectric element.

In some embodiments, the polymer-packaged piezoelectric element and the enclosure are connected only partially along certain sections of the perimeter, thus providing different lip-conditions resulting in various vibratory modes developing across the surface of the polymer-packaged piezoelectric element.

In some embodiments, the polymer-packaged piezoelectric element and the enclosure have shapes other than circular, and are attached to one another fully or only partially along the entire lip or only along certain sections of the lip.

In one embodiment, the enclosure contains a ventilation outlet allowing passage of gasses into and out of the enclosure such that pressure or vacuum do not build up in the enclosure during actuation.

In some embodiments, the polymer-packaged piezoelectric element can be used as an actuator without the enclosure and then the vibrations will have different distribution over the polymer-packaged piezoelectric element surface.

In some embodiments the surface of the polymer-packaged piezoelectric element on the side facing the skin is textured to produce a different mechanical stimulation of the skin. Such texture can be for example a grid of bubble shaped bodies that will cover the surface of the polymer-packaged piezoelectric element.

In some embodiments, the enclosure is open in both sides. For example, in the case of a circular polymer-packaged piezoelectric element, the enclosure will have the shape of an open ring.

In some embodiments, the polymer-packaged piezoelectric element contains one piezoelectric element, two piezoelectric elements, or a stack of more than two piezoelectric elements. When more than one piezoelectric element is used, an electrode can be placed between piezoelectric elements—for example a single electrode or a double sided copper clad, flexible adhesive free polyimide dielectric laminate.

The piezoelectric element(s) can be packaged in the protective layer using polyimide or other materials including polyetherketones, polyetheretherketones, polybenzimidazoles, polyphenylensulfides, silicone, polyamidimides, polysulfones, polyethersulfones, liquid crystalline polymers, or combinations thereof. In addition, more than one layer of polymer can be used where different polymers are used in each layer.

In another aspect, the invention provides a skin attachment mechanism for attaching the actuator to the skin of the subject. In one embodiment, the skin attachment article includes a cover, a mounting pad, a connecting strip flexibly connecting the mounting pad and the cover, and a first adhesive layer for attaching the article to skin of a subject with the mounting pad contacting the skin and the cover overlying the mounting pad such that an outer perimeter of the cover is spaced outward from an outer perimeter of the mounting pad.

In one embodiment, the actuator is attached to the skin by means of a double sided adhesive layer or gel such that the actuator is delivering the vibrations to the skin through the adhesive layer or gel. In another embodiment, the actuator is placed directly over the skin and fixed to the skin using a fixation method such as adhesive tape, strap or other fixation method that is applied over the actuator.

The edges of the polymer-packaged piezoelectric element and/or the edges of the enclosure may be tapered, beveled, rounded or otherwise modified as to minimize potential damage to the skin, underlying tissue, or fixation method (adhesive or other) that attaches the actuator to the skin.

The actuation frequencies used with the actuator can range from 1 Hz to 4 kHz. Preferred actuation frequencies for use in therapeutic applications that are not ultrasonic, ranges from 1 Hz to 500 Hz, and in some embodiments, from 5 Hz to 100 Hz. Preferred actuation amplitudes for use in stimulation of tissue response in therapeutic applications ranges from 0.001 millimeters to 3 millimeter peak-to-peak.

In one embodiment, the actuator of this invention is attached to the skin using an adhesive-based attachment system. This system contains three components. The first component is a double sided adhesive mounting pad that is attached to the skin on one side and the actuator is attached to the opposite side with the actuator facing the skin. The mounting pad can be made of woven, nonwoven or hydrogel materials, as well as other types of gel, foam or film. The mounting pad can be breathable or not breathable and in some embodiments, it can be perforated.

The second component of the adhesive-based attachment system is a top cover larger in perimeter size than the actuator and mounting pad, that covers the actuator fully or partially to reinforce the attachment of the actuator to the skin. In one embodiment, the top cover is made of flexible material that will conform to the shape of the actuator and will fasten the actuator to the skin by applying pressure over the actuator. Such flexible material can be woven, nonwoven or made of foams, films, gels, or layers such as polyurethane, polyethylene or polyvinyl chloride. The top cover can be breathable or not breathable and in some embodiments, it can be perforated.

The third component of the adhesive-based attachment system is a connecting strip in the form of an adhesive double sided strip that connects the mounting pad and the top cover. The connecting strip can help hold the double-sided mounting pad and top cover in the right position allowing easy positioning of the top cover over the actuator. In some embodiments, the connecting strip can be an integral part of the mounting pad or the top cover. In some embodiments, the connecting strip can be coated with adhesive on the skin side or both sides thereby positioning the adhesive patch folding point. In some embodiments, the connecting strip has no adhesive. In one embodiment, the connecting strip is not included and the double-sided mounting pad and the top cover are provided as two separate units.

In another embodiment, there is a pressure-relief apparatus added to the attachment system, for example in the form of a foam ring that fits around the outside perimeter of the actuator.

In some embodiments, the actuator can be used over healthy tissue to stimulate vascular response that will for example be anti-thrombotic. Such use can be for example delivery of vibrations during medical procedures that have risk of thrombosis or long sitting time such as during travel. Vibrations can promote blood flow thereby induce fibrinolysis and reduce the risk of thrombosis.

In one aspect the invention provides an actuator for delivering mechanical vibrations to the body of a subject. The actuator includes a piezoelectric element, electrodes in electrical or wireless communication with a power source and/or a signal source and the piezoelectric element to drive the piezoelectric element, a protective layer encapsulating the piezoelectric element and at least part of the electrodes, the protective layer comprising a polymeric material, and an enclosure attached to the protective layer and defining a space between the protective layer and the enclosure allowing desired modes of vibration to develop across a surface of the protective layer. In one form, a perimeter of the protective layer is affixed to a perimeter of the enclosure thus providing mechanical lip-conditions that prevent and/or minimize motion of the piezoelectric element at its perimeter. In one form, the protective layer and the enclosure are affixed only partially along certain sections of the perimeter of the protective layer and the perimeter of the enclosure. The enclosure can include a ventilation outlet. In one form, an outer perimeter of the protective layer is spaced outward from an outer perimeter of the piezoelectric element. The actuator can include one or more additional piezoelectric elements encapsulated in protective layers.

The actuator can transmit vibrations to skin or other body tissue of the subject when the actuator is placed on the skin or other body tissue with the protective layer facing the body either directly or through an intermediate layer and when electrical signals are delivered to the piezoelectric element from a control unit. In one form, the polymeric material is selected from polyimides, polyetherketones, polyetheretherketones, polybenzimidazoles, polyphenylensulfides, silicones, polyamidimides, polysulfones, polyethersulfones, liquid crystalline polymers or combinations thereof. The protective layer can be polymerized on the piezoelectric element. The protective layer can be a sheet laminated or glued to the piezoelectric element, and the laminated or glued sheet includes the electrodes that will deliver electric signal to the piezoelectric element. The polymeric material can be selected from polyimides. The protective layer can be surrounded by a pressure-relief apparatus. The enclosure can include opposed open ends. In one form, the actuator is not attached to an enclosure. In one form, the piezoelectric element comprises a lead zirconate titanate. The edges of the enclosure can be tapered, beveled, or rounded, and/or edges of the protective layer can be tapered, beveled, or rounded. The actuation frequencies for the piezoelectric element can range from 1 Hz to 4 kHz. The actuation amplitudes for the piezoelectric element can range from 0.001 millimeters to 3 millimeter peak-to-peak. In one form, a surface of the protective layer is not smooth and has a texture to enhance a stimulatory effect. In one form, a diameter of the protective layer is bigger than a diameter of the piezoelectric element.

The actuator can include a sensor in electrical or wireless communications with a power source and/or a signal source and/or the piezoelectric element, such that that input from the sensor modifies the power and/or signal from the source to the piezoelectric element or modifies the response of the piezoelectric element to such power or signals from the source. The sensor can be selected from perfusion sensors, oxygenation sensors, piezo-film sensors, temperature sensors, photoplethysmographic sensors, strain-gauge plethysmography sensors, laser-Doppler sensors, laser-speckle sensors, infrared imaging, infrared spectography, ultrasound sensors, motion sensors, strain sensors, pressure sensors, and vibration sensors.

The actuator can further include: at least one of: devices for applying negative pressure below or around or adjacent to the actuator, hyperbaric oxygen devices, compression devices, shockwave devices, heating devices, cooling devices, light-emitting devices, ultrasound devices, electromagnetic stimulation devices, electrical current stimulation devices and wound dressings. The actuator can be used for increase in tissue perfusion, increase in tissue oxygenation, pain alleviation, muscle injuries, bone injuries, enhancement of bone growth, enhancement of cartilage growth, tissue repair and/or tissue regeneration, inflammation, balance dysfunction, erectile dysfunction, neuropathy, sleep disorders, chronic and other wounds such as pressure ulcers, venous ulcers, arterial ulcers, and diabetic ulcers, burns, surgical wounds, dehisced wounds, preventive treatment for pressure ulcers, transdermal drug delivery, osteoporosis, cellulite removal, neurological conditions, Parkinson's disease tremor reduction, fibromyalgia, veterinary use, and other therapeutic uses.

In another aspect the invention provides a skin attachment article including a cover, a mounting pad, a connecting strip flexibly connecting the mounting pad and the cover, and a first adhesive layer for attaching the article to skin of a subject with the mounting pad contacting the skin and the cover overlying the mounting pad such that an outer perimeter of the cover is spaced outward from an outer perimeter of the mounting pad. In one form, the first adhesive layer is disposed on a bottom surface of the cover. In one form, the mounting pad includes a second adhesive layer disposed on a bottom surface of the mounting pad, and the second adhesive layer attaches the mounting pad to the skin of the subject. In one form, the mounting pad includes a third adhesive layer disposed on a top surface of the mounting pad, and the third adhesive layer attaches a medical apparatus to the mounting pad. In one form, the connecting strip includes a fourth adhesive layer disposed on a surface of the connecting strip, the fourth adhesive layer for attaching the connecting strip to the skin of the subject.

The article can include the medical apparatus, and the medical apparatus can be an actuator for delivering mechanical vibrations to the skin of the subject. The actuator can include (i) a piezoelectric element, and (ii) electrodes in electrical or wireless communication with a power and/or signal source and the piezoelectric element to drive the piezoelectric element, and (iii) a protective layer encapsulating the piezoelectric element and at least part of the electrodes.

In one form of the skin attachment article, the cover comprises a flexible material selected from wovens, non-wovens, films, gels and foams. In one form, the mounting pad comprises a flexible material selected from wovens, non-wovens, films, hydrogels, other types of gels and foams. In one form, the cover comprises a material selected from polyurethane, polyethylene, polyvinyl chloride, and combinations thereof. In one form, the mounting pad comprises a material selected from hydrogels, polyurethane, polyethylene, polyvinyl chloride, and combinations thereof. In one form, the cover comprises a breathable material. In one form, the cover comprises a non-breathable material. In one form, the mounting pad comprises a breathable material. In one form, the mounting pad comprises a non-breathable material. In one form, the cover comprises a perforated material. In one form, the mounting pad comprises a perforated material. In one form, the first adhesive layer is part of a separate tape that attaches the article to the skin of the subject with the mounting pad contacting the skin and the cover overlying the mounting pad. The article can include a pressure-reducing mechanism to reduce unintended pressure thus minimizing risk of pressure-ulcers and other problems developing around, near or under the article.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
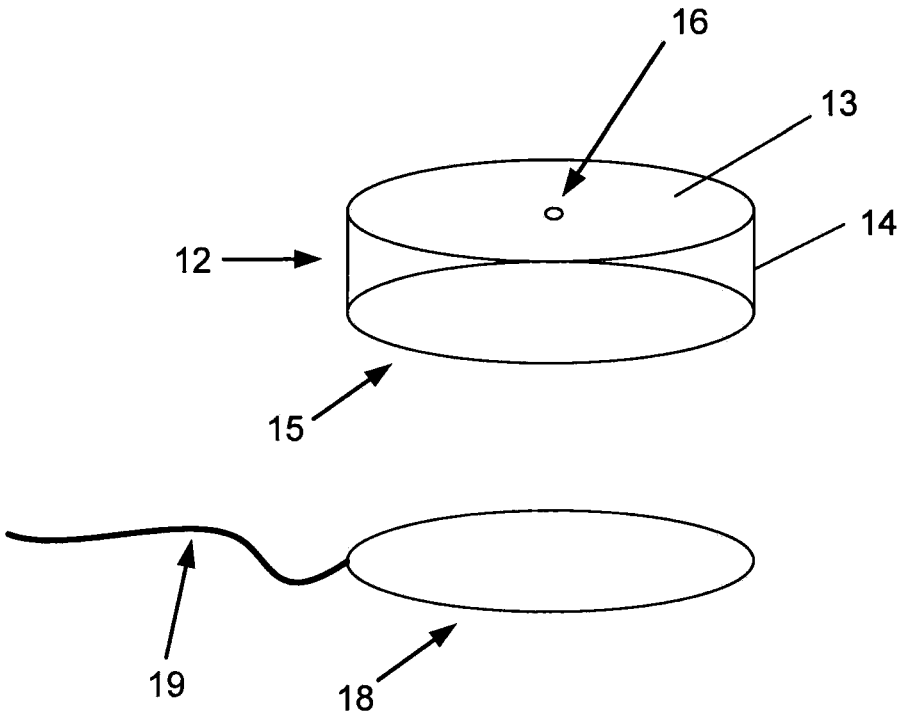
FIG. 1 is an exploded perspective view of one embodiment of a device according to the invention for delivering mechanical vibrations to the body of a subject.
Figure 2:
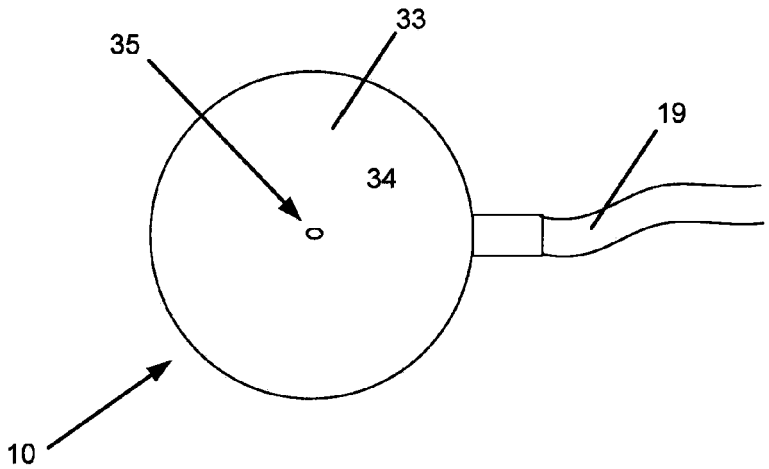
FIG. 2 is a top plan view of an embodiment of an actuator that can be used in a device according to the invention for delivering mechanical vibrations to the body of a subject.

Turning now to FIG. 1, there is shown an exploded perspective view of one example embodiment of a device 10 according to the invention for delivering mechanical vibrations to the body of a subject. The device 10 includes an enclosure 12 having a circular top wall 13 and a round side wall 14 that extends downward from the top wall 13. A central circular vent opening 16 is provided in the top wall 13. The enclosure 12 has a circular open bottom end 15. A polymer-packaged piezoelectric element 18 is placed in electrical communication with an electrical source and controller by way of a connecting electrical lead 19. The controller will normally generate specific electrical signals to drive the actuator. These signals will generate the waveform of the vibrations that may be sinusoidal, pseudo-sinusoidal, square, pulse, chain-saw or other, or combinations thereof as well as the amplitude. The polymer-packaged piezoelectric element 18 is attached to the open bottom end 15 of the enclosure 12 by adhesive, screws or any other means of attachment.

Referring now to FIGS. 2, 3, 4 and 8, there is shown another non-limiting example embodiment of the device 10 (the actuator of this invention). The actuator includes a polymer-packaged piezoelectric element 18, which in turn includes a piezoelectric element in the form of a piezoelectric disk 22 having a diameter of about twenty millimeters and a thickness of about 17 mil (milli-inch). The piezoelectric element can have different shapes for its perimeter 26 such as oval, elliptical, square, rectangular, polygonal, and the like. For circular piezoelectric elements, the diameter may range from about 4 millimeters to about 100 millimeters. For oval and elliptical piezoelectric elements, the major axis may range from about 5 millimeters to about 100 millimeters. For polygonal piezoelectric elements, the length of the largest diagonal may range from about 4 millimeters to about 100 millimeters. The thickness of the piezoelectric element may range from about 2.5 mil to about 50 mil.

The piezoelectric disk 22 preferably comprises a piezoelectric ceramic material that belongs to the family of lead zirconate titanate ($Pb[Zr_xTi_{1-x}]O_3$ $0 \leq x \leq 1$), also called PZT. However, other suitable piezoelectric ceramic materials include lead metaniobate $Pb(Nb_2O_6)$, modified lead titanate $PbTi_3$ such as $(Pb,Ca)TiO_3$ and $(Pb,Sm)TiO_3$, barium titanate $BaTiO_3$, lanthanum-doped lead zirconate titanate, and the like. Polymeric piezoelectric materials such as polyvinylidene difluoride (PVDF) are also suitable. One example piezoelectric disk 22 was formed using PZT-5A, sometimes called Navy Type II, or 3195HD. However, many other piezoelectric materials including other members of the PZT family can be used in the present invention. The surface of the piezoelectric element is normally deposited with metal or alloys including nickel, silver, copper or gold which act as electrodes. An additional set of electrodes is attached to both sides of the piezoelectric element and to a power and control unit used for delivery of electrical signals to the piezoelectric element and distribution of electricity across the piezoelectric element.

The top surface 24 and the opposed bottom surface 25 of the piezoelectric disk 22 are connected to a pair of electrodes 27 which can have the same shape or different shapes. Suitable electrode materials include, without limitation, metals or alloys including copper, silver, nickel, and gold. The electrodes 27 include a ring shaped section 28 connected to a straight section 29 that is in electrical communication with the electrical lead 19. Suitable deposition techniques can be used for making the electrical connection between the piezoelectric disk 22 and the pair of electrodes 27. Multiple layers of the piezoelectric disk 22 and the pair of electrodes 27 can be used. The electrodes 27 and protective layer 31 can be configured as part of a single or double sided copper clad, flexible adhesive free polyimide dielectric laminates.

An outer protective layer 31 is placed in contact with the piezoelectric disk 22 and the pair of electrodes 27 to insulate the piezoelectric disk 22 from the tissue, to protect the piezoelectric disk 22 from liquids, to provide improved resistance to mechanical failure of the piezoelectric disk 22, and to prevent direct contact of the piezoelectric disk 22 with the skin. The protective layer 31 (also called the packaging) can comprise a polymeric material selected from polyimides, polyetherketones, polyetheretherketones, polybenzimidazoles, polyphenylensulfides, silicone, polyamidimides, polysulfones, polyethersulfones, liquid crystalline polymers, and combinations thereof. In addition, more than one protective layer of polymer can be used, and different polymers or a single polymer can be used in each layer. Typically, single or double sided copper clad, flexible adhesive free polyimide dielectric laminate is glued to the piezoelectric element or elements under conditions of pressure and heat using an epoxy glue. In one form, the surface of the protective layer in touch with the skin is not smooth and has a texture to enhance a stimulatory effect.

Example packaging methods include QuickPack™ (available from Mide Technology Corporation, Massachusetts, USA) or DuraAct™ (available from Physik Instrumente, Lederhose, Germany). Different packaging methods of the piezoelectric actuator can be used, some of which include polymerization directly over the piezoelectric material or use of films such as polyimide film to coat the piezoelectric material. In some embodiments, more than one layer of polymer can be used and different polymers can be used in combinations.

Figure 3:
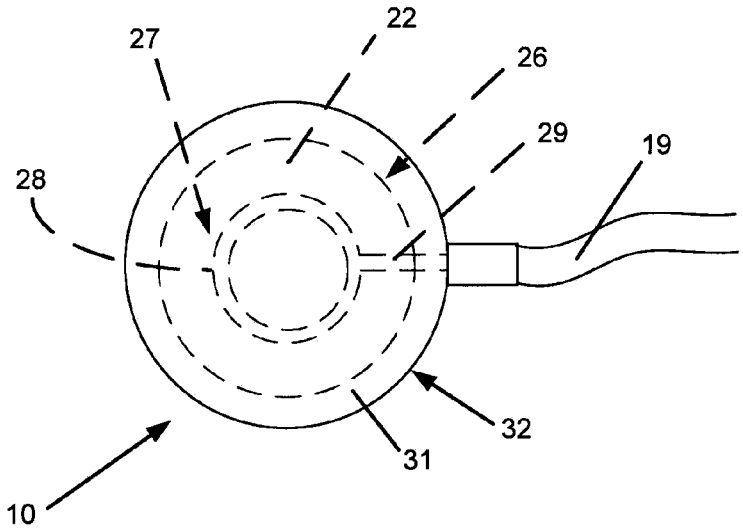
FIG. 3 is a bottom plan view of the actuator of FIG. 2.
Figure 4:
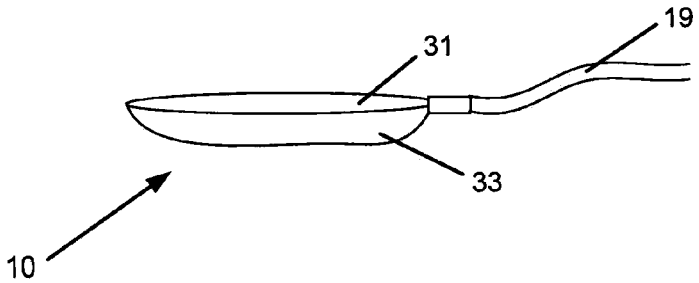
FIG. 4 is a side elevational view of the actuator of FIG. 2.

An example version of the actuator of FIG. 3 was prepared and included a double layered piezoelectric disk 22 packaged in a polyimide layer having a total thickness of about 17 mil (by mil, we mean milli-inch, i.e., 0.001") and a diameter of about thirty millimeters. It can be seen from FIG. 3 that the perimeter 26 of the piezoelectric disk 22 in this example embodiment is spaced inward from the outer perimeter 32 of the protective layer 31. By extending the protective layer 31 outward beyond the perimeter 26 of the piezoelectric disk 22 with polyimide, we increased the generated amplitude while keeping the piezoelectric disk 22 small. The advantage is due to the mechanical properties provided by the polyimide packaging which extends beyond the diameter of the actual piezoelectric element. For a circular protective layer, the diameter may range from about 4 millimeters to about 150 millimeters. For an oval or elliptical protective layer, the major axis may range from about 5 millimeters to about 160 millimeters. For a polygonal protective layer, the length of the largest diagonal may range from about 4 millimeters to about 150 millimeters. The thickness of the protective layer on each side of the piezoelectric element may range from about 0.5 mil to about 10 mil.

The actuator 10 includes an enclosure 33 having a dome shaped top wall 34 with a central circular vent opening 35. The top wall 34 of the enclosure 33 has an annular bottom surface 37 that is secured to a peripheral upper edge 39 of the protective layer 31 thus providing mechanical lip-conditions (preventing/minimizing motion of the polymer-packaged piezoelectric element 18 at the perimeter) and allowing a diaphragm-like movement at the center of the circular polymer-packaged piezoelectric element 18. The enclosure 33 can comprise a polymeric material such as polyethylene, nylon, polypropylene or other plastic martial. Alternatively, the enclosure can be a non polymeric material such as metal. The dome shaped top wall 34 of the enclosure 33 creates a free space 41 between the dome shaped top wall 34 and the piezoelectric actuator 18 so that desired vibratory modes and desired amplitudes can develop across the surface of the polymer-packaged piezoelectric element 18. The enclosure 33 preferably has the same perimeter dimensions as the protective layer 31.

Turning now to FIGS. 5 to 8, a device according to the invention for delivering mechanical vibrations to the body of a subject includes an adhesive patch 50 having a top cover 52 having an oval perimeter 53 and a bottom surface 54. The cover 52 can have different shapes for its perimeter 53 such as circular, elliptical, square, rectangular, polygonal, and the like. The cover 52 has a vent opening 57. The cover 52 is made of flexible material that will conform to the shape of the actuator 10 and will fasten the actuator 10 to the skin by applying pressure over the actuator 10. Such flexible material can be woven, non-woven or made of foams, films or gels or layers such as polyurethane, polyethylene or polyvinyl chloride. The cover 52 can be breathable or not breathable and in some embodiments, it can be perforated. The bottom surface 54 of the cover 52 can be coated with an adhesive to create an adhesive structure wherein at least a portion of the bottom surface 54 is attached to the skin. Release liners can be positioned over the adhesive layer on the bottom surface 54 of the cover 52. For a circular cover 52, the diameter may range from about 10 millimeters to about 200 millimeters. For an oval or elliptical cover 52, the major axis may range from about 12 millimeters to about 250 millimeters. For a polygonal cover 52, the length of the largest diagonal may range from about 10 millimeters to about 200 millimeters. The thickness of the cover 52 may range from about 0.2 millimeters to about 3 millimeters.

The adhesive patch 50 includes a mounting pad 55 having a circular perimeter 56. The mounting pad 55 can have different shapes for its perimeter 56 such as oval, elliptical, square, rectangular, polygonal, and the like. The mounting pad 55 includes a top surface 58 and an opposed bottom surface 59. The top surface 58 and the bottom surface 59 can be coated with an adhesive to create a double sided adhesive structure wherein the bottom surface 59 is attached to the skin on one side and the piezoelectric actuator 18 is attached to the top surface 58 of the mounting pad 55. The mounting pad 55 can be made of woven, nonwoven or hydrogel materials, as well as foam. The mounting pad 55 can be breathable or not breathable and in some embodiments, it can be perforated. Suitable release liners can be positioned over the adhesive layers on the top surface 58 and the bottom surface 59 of the mounting pad 55.

For a mounting pad 55, the diameter may range from about 4 millimeters to about 160 millimeters. For an oval or elliptical mounting pad 55, the major axis may range from about 5 millimeters to about 170 millimeters. For a polygonal mounting pad 55, the length of the largest diagonal may range from about 4 millimeters to about 160 millimeters. The thickness of the mounting pad 55 may range from about 0.025 millimeters to about 2 millimeters.

In the adhesive patch 50, the cover 52 and the mounting pad 55 are attached by a connecting strip 62. The connecting strip 62 can be in the form of an adhesive double sided flexible strip. The connecting strip 62 can help hold the mounting pad 55 and cover 52 in the right position allowing easy positioning of the cover 52 over the actuator 10. In some embodiments, the connecting strip 62 can be an integral part of the mounting pad 55 or the cover 52. In some embodiments, the connecting strip 62 can be coated with adhesive on the skin side or both sides thereby positioning the folding point of the adhesive patch 50. In some embodiments, the connecting strip 62 has no adhesive. In one embodiment, the connecting strip 62 is not included and the mounting pad 55 and the cover 52 are provided as two separate units.

Figure 5:
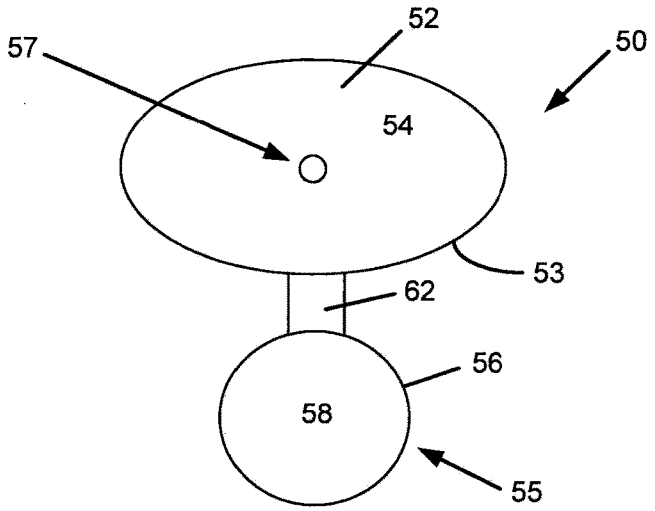
FIG. 5 is a top plan view of an adhesive patch according to the invention for securing the actuator of FIG. 2 to the body of a subject.
Figure 6:
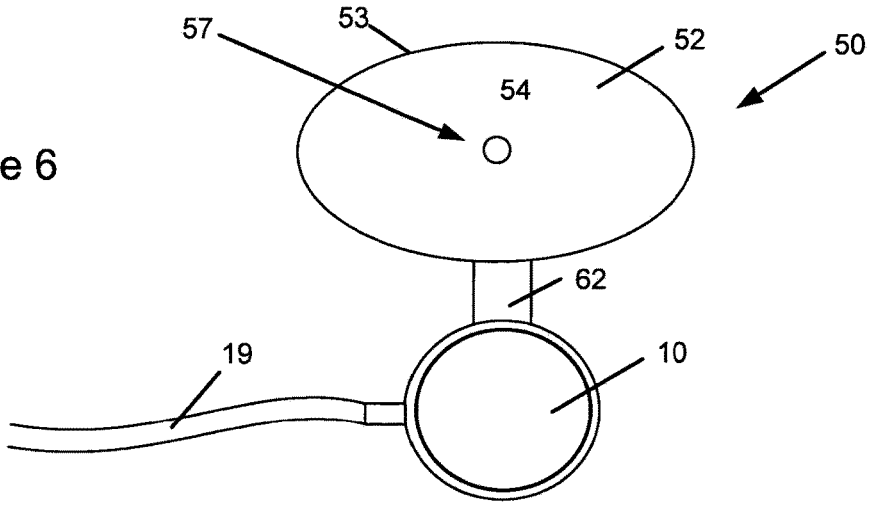
FIG. 6 is a top plan view of the adhesive patch of FIG. 5 with the actuator of FIG. 2 secured to a mounting pad of the adhesive patch of FIG. 5.
Figure 7:
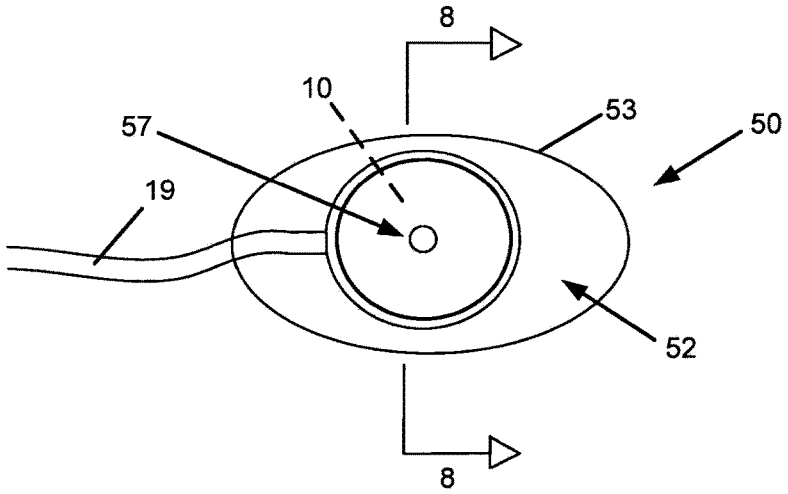
FIG. 7 is a top plan view of the adhesive patch of FIG. 5 having secured the actuator of FIG. 2 to the body of a subject.
Figure 8:
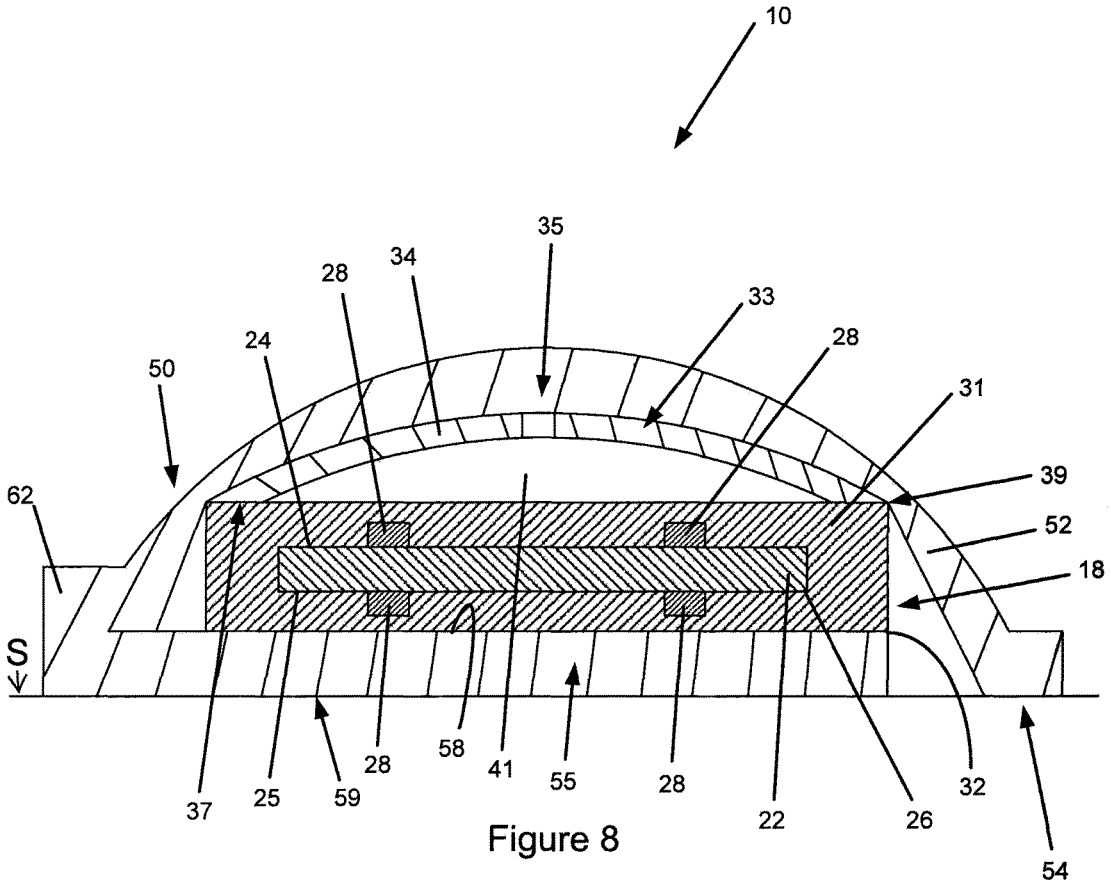
FIG. 8 is a cross-sectional view taken along line 8-8 of FIG. 7 showing the adhesive patch of FIG. 5 having secured the actuator of FIG. 2.

Referring still to FIGS. 5-8, a device according to the invention for delivering mechanical vibrations to the body of a subject can be attached to the subject as follows. In FIGS. 5 and 8, after removing any release liner, the bottom surface 59 of the mounting pad 55 is attached to the skin S of the subject by way of the adhesive on the bottom surface 59 of the mounting pad 55. In FIG. 6, after removing any release liner on the mounting pad 55, the actuator 10 is attached to the top surface 58 of the mounting pad 55 by way of the adhesive on the top surface 58 of the mounting pad 55. The adhesive patch 50 is then folded at the connecting strip 62 and the top cover 52 is attached to the actuator 10 and the skin S of the subject by way of adhesive on the bottom surface 54 of the top cover 52. The device according to the invention for delivering mechanical vibrations to the body of a subject is therefore attached to the skin S of the subject as shown in FIGS. 7 and 8.

In a different embodiments other attachment mechanisms can be used such as placing the actuator under compression wrap, stretchable hook and loop fastener strap sold under the name Velcro™, bandage or other means of attachment that will result in direct contact of the actuator surface with a tissue.

Figure 9:
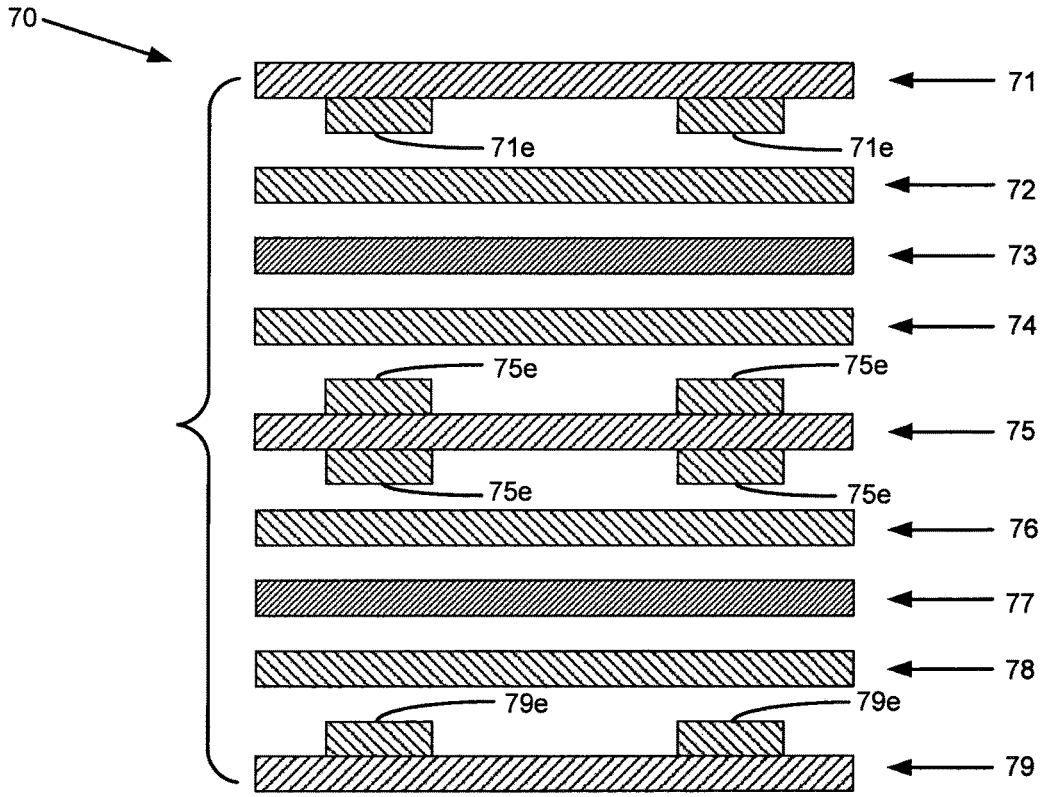
FIG. 9 is an exploded side cross-sectional view of another embodiment of a polymer-packaged piezoelectric element that can be used in a device according to the invention for delivering mechanical vibrations to the body of a subject.

Turning to FIG. 9, there is shown an exploded side cross-sectional view of another embodiment of a polymer-packaged piezoelectric element 70 that can be used in a device according to the invention for delivering mechanical vibrations to the body of a subject. The polymer-packaged piezoelectric element 70 includes a single sided copper clad flexible adhesiveless polyimide dielectric laminate 71 with copper electrodes 71*e*. The laminate 71 is attached by an epoxy glue layer 72 to one side of a first piezoelectric element 73. The first piezoelectric element 73 preferably comprises a piezoelectric ceramic material as used in the piezoelectric disk 22 described above. An epoxy glue layer 74 attaches one side of a double sided copper clad flexible adhesiveless polyimide dielectric laminate 75 to an opposite side of the first piezoelectric element 73. The laminate 75 has copper electrodes 75*e*. An epoxy glue layer 76 attaches an opposite side of the double sided copper clad flexible adhesiveless polyimide dielectric laminate 75 to one side of a second piezoelectric element 77. An epoxy glue layer 78 attaches an opposite side of the second piezoelectric element 77 to a single sided copper clad flexible adhesiveless polyimide dielectric laminate 79. The laminate 79 has copper electrodes 79*e*. One non-limiting example polymer-packaged piezoelectric element 70 has a thickness of 17 mils.

Figure 10:
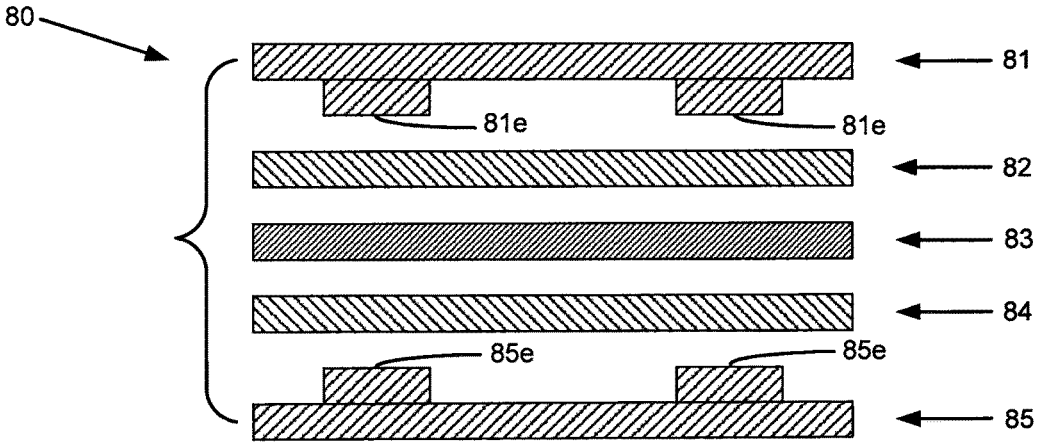
FIG. 10 is an exploded side cross-sectional view of yet another embodiment of a polymer-packaged piezoelectric element that can be used in a device according to the invention for delivering mechanical vibrations to the body of a subject.

Turning to FIG. 10, there is shown an exploded side cross-sectional view of yet another embodiment of a polymer-packaged piezoelectric element 80 that can be used in a device according to the invention for delivering mechanical vibrations to the body of a subject. The polymer-packaged piezoelectric element 80 includes a single sided copper clad flexible adhesiveless polyimide dielectric laminate 81 that is attached by an epoxy glue layer 82 to one side of a piezoelectric element 83. The laminate 81 has copper electrodes 81*e*. The piezoelectric element 83 preferably comprises a piezoelectric ceramic material as used in the piezoelectric disk 22 described above. An epoxy glue layer 84 attaches an opposite side of the piezoelectric element 83 to a single sided copper clad flexible adhesiveless polyimide dielectric laminate 85.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. An actuator for delivering mechanical vibrations to the body of a subject, the actuator comprising:

a piezoelectric element;

electrodes in electrical communication with a power source and/or a signal source and the piezoelectric element to drive the piezoelectric element;

a protective layer encapsulating the piezoelectric element and at least part of the electrodes, the protective layer comprising a polymeric material;

an enclosure attached to the protective layer and defining a space between the protective layer and the enclosure allowing desired modes of vibration to develop across a surface of the protective layer; and a perimeter in a top view of the protective layer is affixed to a perimeter in a top view of the enclosure thus providing mechanical lip-conditions that prevent and/or minimize motion of the piezoelectric element at its perimeter.

2. The actuator of claim 1 wherein:

the enclosure includes a ventilation outlet.

3. The actuator of claim 1 wherein:

an outer perimeter of the protective layer is spaced outward from an outer perimeter of the piezoelectric element.

4. The actuator of claim 1 wherein:

the protective layer is a sheet laminated or glued to the piezoelectric element.

5. The actuator of claim 1 wherein:

the laminated or glued sheet includes the electrodes that will deliver electric signal to the piezoelectric element.

6. The actuator of claim 1 wherein:

the protective layer is surrounded by a pressure-relief apparatus.

7. The actuator of claim 1 wherein:

actuation frequencies for the piezoelectric element range from 1 Hz to 4 kHz.

8. The actuator of claim 1 wherein:

actuation amplitudes for the piezoelectric element range from 0.001 millimeters to 3 millimeter peak-to-peak.

9. The actuator of claim 1, further comprising:

a sensor in electrical communications with a power source and/or a signal source and/or the piezoelectric element, such that that input from the sensor modifies the power and/or signal from the source to the piezoelectric element or modifies the response of the piezoelectric element to such power or signals from the source.

10. The actuator of claim 9 wherein:

the sensor is selected from perfusion sensors, oxygenation sensors, piezo-film sensors, temperature sensors, photoplethysmographic sensors, strain-gauge plethysmography sensors, laser-Doppler sensors, laser-speckle sensors, infrared imaging, infrared spectography, ultrasound sensors, motion sensors, strain sensors, pressure sensors, and vibration sensors.

11. A skin attachment article for providing tissue therapy, the article comprising:

a cover;

a mounting pad;

a connecting strip flexibly connecting the mounting pad and the cover;

a first adhesive layer for attaching the article to skin of a subject with the mounting pad contacting the skin and the cover overlying the mounting pad such that an outer perimeter of the cover is spaced outward from an outer perimeter of the mounting pad; and the actuator of claim 1.

12. The article of claim 11 wherein:

the mounting pad includes a third adhesive layer disposed on a top surface of the mounting pad, the third adhesive layer for attaching the actuator to the mounting pad.

13. The article of claim 11 wherein:

the cover comprises a flexible material selected from wovens, non-wovens, films, gels and foams.

14. The article of claim 11 wherein:

the cover comprises a perforated material, and the mounting pad comprises a perforated material.

15. The article of claim 11 wherein:

the first adhesive layer is part of a separate tape that attaches the article to the skin of the subject with the mounting pad contacting the skin and the cover overlying the mounting pad.

16. The article of claim 11 further comprising:

a pressure-reducing mechanism to reduce unintended pressure thus minimizing risk of pressure-ulcers and other problems developing around, near or under the article.

17. The article of claim 11 wherein:

the outer perimeter of the cover is spaced outward from the outer perimeter of the mounting pad thereby defining an unobstructed path from the skin of the subject to a bottom surface of the cover between the mounting pad and the cover.

18. An actuator for delivering mechanical vibrations to the body of a subject, the actuator comprising:

a piezoelectric element;

electrodes in electrical communication with a power source and/or a signal source and the piezoelectric element to drive the piezoelectric element;

a protective layer encapsulating the piezoelectric element and at least part of the electrodes, the protective layer comprising a polymeric material;

an enclosure attached to the protective layer and defining a space between the protective layer and the enclosure allowing desired modes of vibration to develop across a surface of the protective layer; and wherein the protective layer is on all sides of the piezoelectric element in a transverse cross-sectional view, and a perimeter in a top view of the protective layer is affixed to a perimeter in a top view of the enclosure thus providing mechanical lip-conditions that prevent and/or minimize motion of the piezoelectric element at its perimeter.

19. The actuator of claim 18 wherein the protective layer is further configured for contraction and expansion corresponding to the contraction and expansion of the piezoelectric element, respectively.

* * * * *